United States Patent [19]

Porter

[11] Patent Number: 4,873,832

[45] Date of Patent: Oct. 17, 1989

[54] LIQUID LEVEL CONTROL FOR A CRYOGENIC FLUID

[75] Inventor: Warren W. Porter, Escondido, Calif.

[73] Assignee: NCR Corporation, Dayton, Ohio

[21] Appl. No.: 281,310

[22] Filed: Dec. 8, 1988

[51] Int. Cl.[4] ..... F17C 13/02

[52] U.S. Cl. ..... 62/49.2; 137/432; 137/449

[58] Field of Search ..... 62/49; 137/432, 449

[56] References Cited

U.S. PATENT DOCUMENTS

| | | | |
|---|---|---|---|
| 1,623,374 | 4/1927 | Anderson | 137/449 |
| 1,783,891 | 12/1930 | Thibert | 137/434 |
| 1,942,908 | 1/1934 | Swain et al. | 137/68 |
| 2,009,649 | 3/1934 | Carlson | 137/68 |
| 2,628,631 | 2/1953 | Boyd | 137/430 |
| 2,682,889 | 7/1954 | McLaughlin | 137/449 |
| 2,777,296 | 1/1957 | Schilling | 62/49 |
| 3,104,677 | 9/1963 | Fleckenstein et al. | 137/391 |
| 3,450,102 | 6/1969 | Davis et al. | 119/80 |
| 3,469,597 | 9/1969 | Bagullo | 62/49 |
| 3,752,217 | 8/1973 | Sevier | 137/432 |
| 3,835,919 | 9/1974 | Lambrecht et al. | 165/47 |
| 3,985,836 | 10/1976 | Fischer | 137/432 |
| 4,462,417 | 7/1984 | Trinkwalder, Jr. | 137/449 |
| 4,506,512 | 3/1985 | Delacour et al. | 62/49 |
| 4,561,258 | 12/1985 | Brodbeck et al. | 62/49 |
| 4,592,205 | 6/1986 | Brodbeck et al. | 62/49 |

*Primary Examiner*—Ronald C. Capossela

*Attorney, Agent, or Firm*—Wilbert Hawk, Jr.; Stephen F. Jewett; Jack R. Penrod

[57] ABSTRACT

A simple and reliable liquid level control for controlling the level of a cryogenic fluid within an enclosure for an electrical component. This totally mechanical system varies the flow rate of the cryogenic fluid from a supply conduit until the full level is attained at which point the flow is completely turned off. Details of materials used and construction considerations made in order to operate in this somewhat unstable environment are presented. The design includes the passages for exhausting the evaporated cryogenic fluid that is boiled off by the heat from the electrical component in the enclosure.

12 Claims, 3 Drawing Sheets

LIQUID LEVEL CONTROL FOR A CRYOGENIC FLUID

BACKGROUND OF THE INVENTION

The present invention relates to a liquid level control, and more particularly to a control having a float for sensing the level of a cryogenic fluid to control a metering valve of that cryogenic fluid.

Cryogenic fluids have been used to cool semiconductor components for various reasons. One such reason is that the application of liquid nitrogen to a VLSI CMOS integrated circuit increases the switching speed. This is described in U.S. Pat. No. 4,800,422 by J. Sanwo entitled "A FROSTLESS INTERFACE SUPERCOOLED VLSI SYSTEM." Furthermore, a container for mounting such a supercooled VLSI system is described in U.S. Pat. No. 4,805,420 by Porter et al. entitled "CRYOGENIC VESSEL FOR COOLING ELECTRONIC COMPONENTS." Both of these applications are assigned to NCR Corporation, Dayton, Ohio; and are both hereby incorporated by reference. The problem with the invention disclosed in Porter et al. is that the level of the cryogenic fluid within the cryogenic vessel is difficult to maintain at the level necessary to cool the component mounted therein. The level could be maintained by a free-flow, gravity system, but such systems have difficulties during the filling or other maintenance of the cryogenic fluid reservoir.

Commercial cryogenic fluid level sensors and solenoid controlled cryogenic valves were tested. A fluid logic based sensor had to be immersed at least six inches below the surface of the cryogenic fluid in order to operate properly. In addition to the six inch sensor depth required below the liquid level, a gas collection space is required above the liquid level to gather the evaporated cryogenic liquid. Further, for the most advantageous placement of the solenoid control valve, additional space above the gas collection space is required. Thus, the fluid logic level control proved to require too much space in order to cool a relatively small electronic component.

Another approach uses a vertical array of temperature sensors as the level sensor. Those temperature sensors which are immersed in the cryogenic fluid will all have the same output voltage, while those temperature sensors which are above the level of the cryogenic fluid will have a voltage indicative of a warmer temperature. Thus, by comparing the output voltages from each member of the vertical array the level of the fluid may be sensed. A control circuit to operate a solenoid control valve is straight forward after the level sensor apparatus is decided upon. An initial experiment with such an array yielded a level control system having a solenoid control valve which was constantly turning on and off to regulate the level of an evaporating cryogenic fluid. The constant cycling of the control circuit causes an increased amount of electromagnetic interference in an a region where such interference must be carefully controlled, and the constant cycling of the solenoid valve typically leads to a high wear out rate, which is undesirable from a reliability and maintenance standpoint. A liquid level hysteresis reduces the number and frequency of the solenoid valve cycles, but it requires an increased volume within the cooling enclosure to accommodate the excess cryogenic fluid admitted during each 'on' stage to be evaporated during the subsequent 'off' stage. The extra volume is undesirable because, as stated previously, it requires too much space to simply cool a relatively small electronic component.

A non-hysteresis system using either multiple solenoid valves, or using a solenoid valve with a variable flow rate, was considered undesirable because of the increased complexity and the increased expense.

It is therefore an object of this invention to provide a mechanical liquid level control for a cryogenic fluid.

It is another object of this invention to provide a mechanical liquid level control for a cryogenic fluid that has a variable flow rate dependent upon the level of the cryogenic fluid.

It is another object of this invention to provide a mechanical liquid level control which is reliable when operated in a cryogenic environment.

SUMMARY OF THE INVENTION

Briefly stated, in accordance with one aspect of the invention, the foregoing objects are achieved by providing an apparatus for maintaining a level of a cryogenic fluid within a cooling enclosure, including a float device for positionally responding to the level of the cryogenic fluid; an actuator device, which is connected to the float device, for providing a mechanical force in response to the float device; and a valve device, which is responsive to the actuator device for controlling the flow of cryogenic fluid into the cooling enclosure.

In another aspect of the invention, the foregoing objects are achieved by providing an apparatus for maintaining a level of a cryogenic fluid within a cooling enclosure, including a float device for positionally responding to the level of the cryogenic fluid; an actuator device, which is connected to the float device, for providing a mechanical force in response to the float device; and a valve device, which is responsive to the actuator device for controlling the flow of cryogenic fluid into the cooling enclosure. The float device is disk shaped and has an axially symmetric aperture in its center. The disk shape reduces the sensitivity of the float device to random bubbles generated by the heat from the electrical component mounted in the cooling enclosure in contact with the cryogenic fluid.

BRIEF DESCRIPTION OF THE DRAWINGS

While the specification concludes with the appended claims particularly pointing out and distinctly claiming the subject matter which is regarded as the invention, it is believed that the invention will be better understood from the following description of the illustrative embodiment taken in conjunction with the accompanying drawings in which:

DETAILED DESCRIPTION OF A PREFERRED EMBODIMENT

Figure 1:
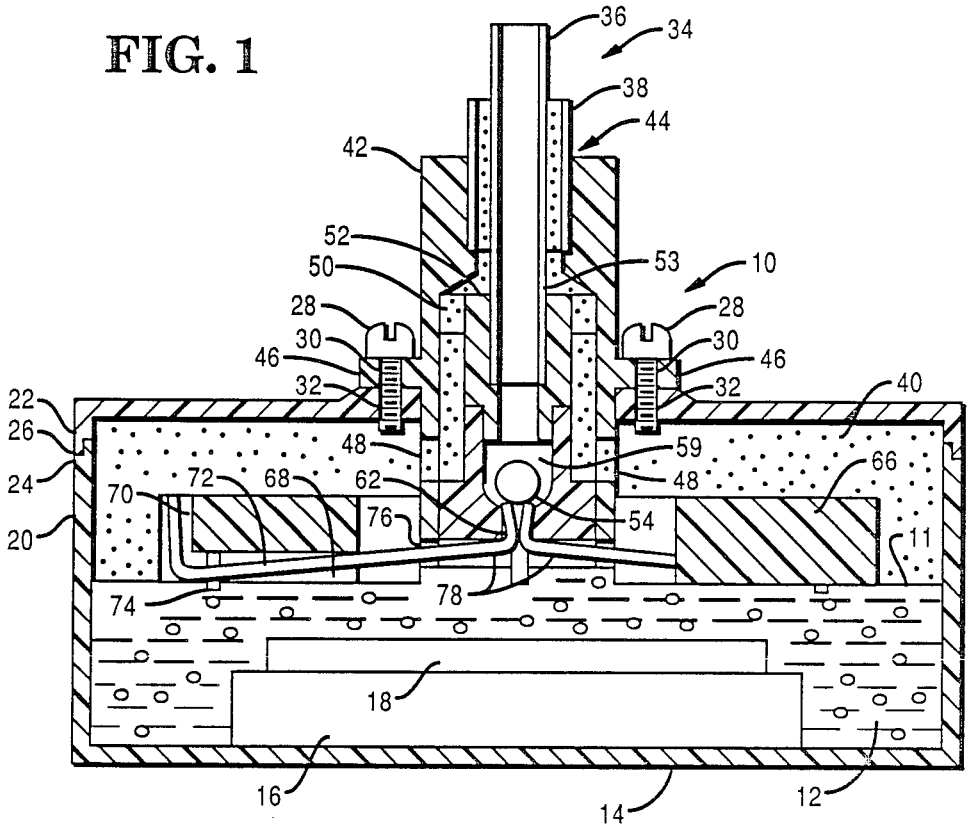
FIG. 1 is a section view of the preferred embodiment of the invention in the valve open position.

Referring now to the drawings, there is shown in FIG. 1 a liquid level control 10 for controlling a level 11 of a cryogenic fluid 12 within an enclosure 14. A connector 16 is located within the enclosure 14, and a semiconductor device 18, such as a VLSI integrated circuit, is electrically connected thereto. The purpose of the liquid level control 10 is to control the level 11 in order to completely immerse the semiconductor device 18 in the cryogenic fluid 12, without over filling the enclosure 14.

The enclosure 14 has a lower portion 20 and an upper portion 22 which are joined along edges 24, 26. The upper portion 22 may be removed from the lower portion 20 in order to install the semiconductor device 18 in the connector 16, to assemble the liquid level control 10 within the enclosure 14, or just general maintenance. The liquid level control 10 is secured to the enclosure 14 by fasteners 28 in holes 30, 32. Affixed to the top of the liquid level control 10 is a cryogenic fluid transfer conduit 34, which has an inner liquid conduit 36 circumferentially enclosed within an outer conduit 38. The inner liquid conduit 36 transports the cryogenic fluid 12 from a reservoir (not shown) to the liquid level control 10. The outer conduit 38 transports the evaporated cryogenic gas 40 that has been boiled off from the cryogenic liquid 12 by the heat from the semiconductor device 18. One such conduit is shown in U.S. Pat. No. 4,745,760 by Porter, issued May 24, 1988 entitled CRYOGENIC FLUID TRANSFER CONDUIT.

The liquid level control 10 has a housing 42 which supports the remainder of the mechanism upon the enclosure 14. The cryogenic fluid transfer conduit 34 is mounted in an axial hole 44 in the housing 42. A mounting device 46, such as a flange, a group of tabs, or other known device, is connected to the housing 42. The holes 30 in the mounting device 46 allow the passage of the fasteners 28 in order to anchor the liquid level control 10 to the enclosure 14.

Figure 2:
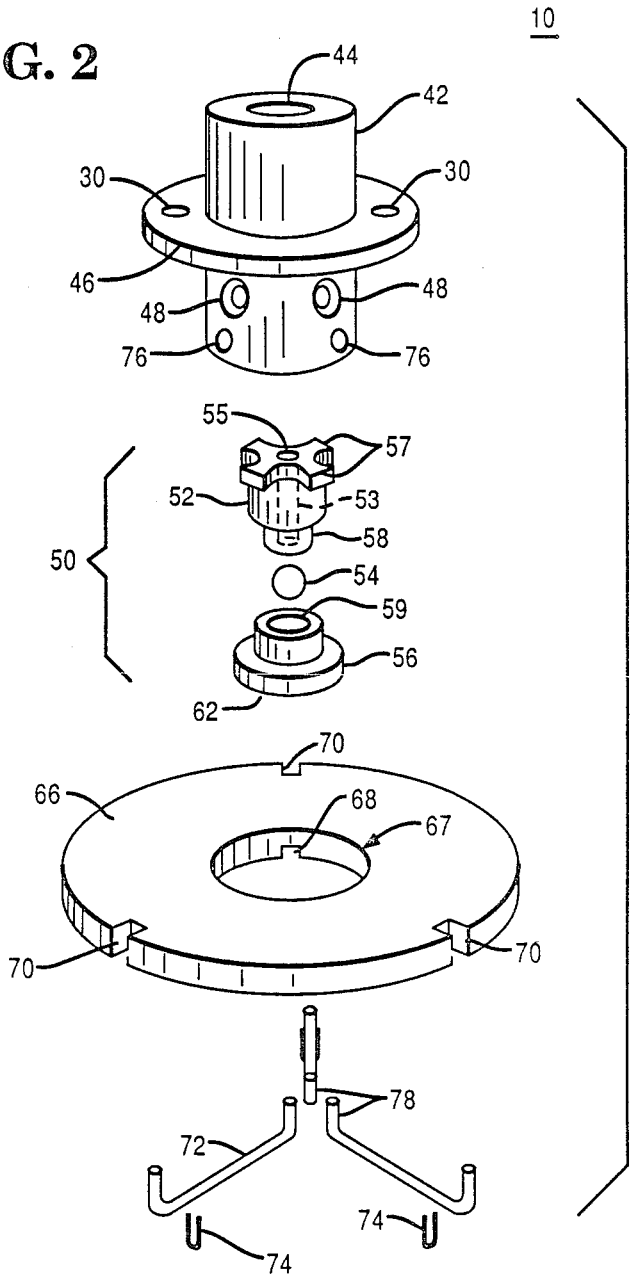
FIG. 2 is a simplified, exploded view of the valve and float mechanisms shown in FIG. 1.

Referring now to FIG. 2, the valve assembly 50 has a guide member 52, a valve member 54, and a valve seat 56. The guide member 52 has an axial hole 53 therethrough. The inner liquid conduit 36 is inserted into the axial hole 53 (see FIG. 1) and effects a fluid tight seal with the surrounding surface 55. A number of radially extending spacers 57, whose purpose will be explained below, are located at the top of the guide member 52. A lower portion 58 of the guide member 52 is adapted to sealably mate with the valve seat 56. The valve seat 56 has a chamber 59 in which the valve member 54, such as a valve ball or other known valve member shapes, is located. The chamber 59 communicates with the axial hole 53 such that cryogenic fluid may flow through the inner liquid conduit 36, through the axial hole 53, and into the chamber 59. The valve member 54 forms a controllable seal with the bottom of the valve seat 56, as will be explained below.

Referring again to FIG. 1, an outlet 62 is located in the valve seat 56, and either controllably communicates with the chamber 59 or is controllably sealed from the chamber 59 according to the control of the valve member 54. When the outlet 62 is opened, some of the cryogenic fluid 12 flows out of the chamber 59 into the enclosure 14, and when the outlet 62 is closed, the chamber 59 is sealed and all such flow ceases.

The valve member 54 is controlled according to the position of a float 66. The float 66 is in the shape of a disk and has a diameter approaching the diameter of the enclosure 14. The diameter of the float 66 is purposely selected to be as large as possible in order to give the float as much stability as available when floating upon a fairly unstable volume of cryogenic fluid 12. The cryogenic fluid 12 may be very unstable during periods when it absorbs relatively large amounts of heat from the semiconductor device 18 and evaporates into bubbles of gas which boil to the top of the cryogenic fluid 12. Thus, the float 66 is made as large as possible to overcome the unstable boiling action of the cryogenic fluid 12.

Figure 3:
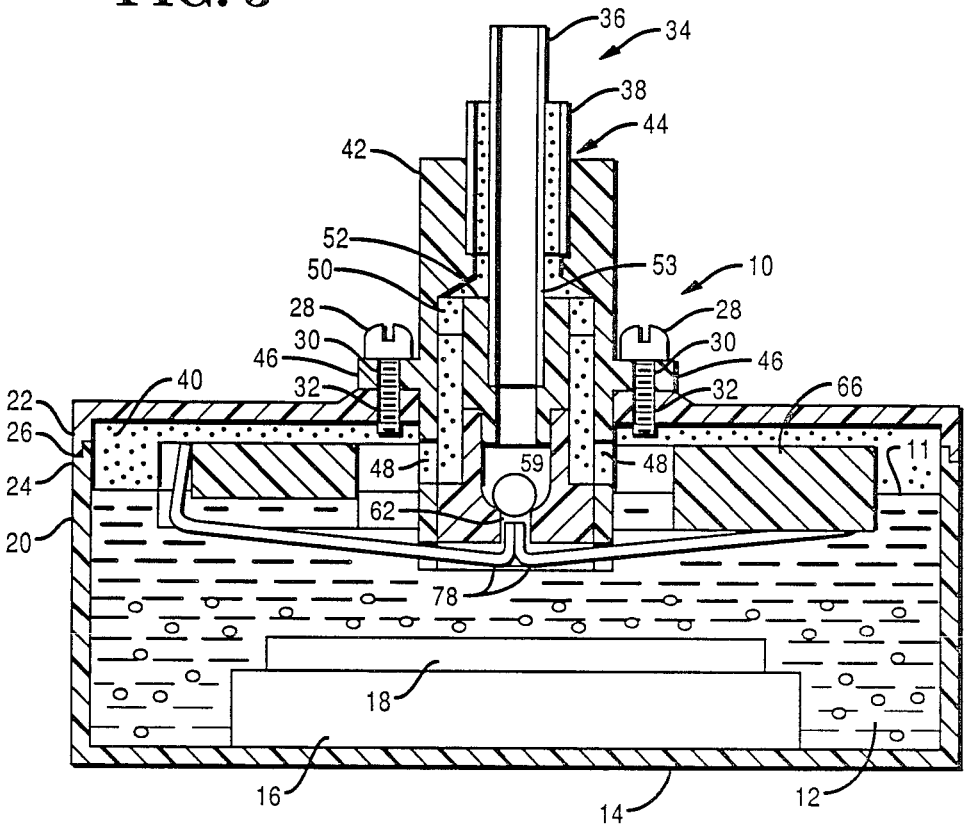
FIG. 3 is a section view of the preferred embodiment of the invention in the valve closed position.

The float 66 has a coaxial aperture 67 located therein of a diameter that is greater than the outside diameter of the housing 42 such that the float 66 may be coaxially located with respect to the housing 42 and vary its position with the level of the cryogenic fluid 12 as shown in FIGS. 1 and 3.

The float 66 has a number of equally spaced channels 68 extending from coaxial aperture 67 to its outer circumference formed on its lower surface. At the circumference of the float 66, each channel 68 communicates with an axial channel 70. Located within each radial channel 68 and its respective axial channel 70 is an actuating lever 72 that is secured therein by a fastener 74. Each actuating lever 72 extends into the coaxial aperture 67 and into a respective hole 76 in the lower portion of the housing 42. Each actuating lever 72 has an end 78 which extends within the housing 42, and is formed to displace the valve member 54 from the valve seat 59 when the level of the cryogenic fluid 12 is below the full level shown in FIG. 3. In the preferred embodiment, each end 78 must penetrate into the outlet 62 to displace the valve member 54, while those skilled in the art will recognize that valve members having other shapes, such as a narrow vertex angle cone, may themselves penetrate into the outlet 62 and, therefore, not require the actuating levers 72 to penetrate into the outlet 62.

The radial bores 48 in the housing 42 communicate with the axial bore 44 to provide an exhaust passage for the evaporated cryogenic liquid 40. After the evaporated cryogenic liquid 40 enters one of the radial bores 48 it is urged, by a slight over pressure caused by the boiling action, to flow between the inside of the housing 42, and the outside of the valve seat 56 and guide 52. The guide 52 is aligned by the force of the radially extending spacers 57 resting against the inside of the housing 42, and the hollows between the radially extending spacers 57 allow the the evaporated cryogenic liquid 40 to continue its upward flow. Near the top of the housing 42, the evaporated cryogenic fluid 40 enters the outer portion 38 of the cryogenic conduit 34 and leaves the liquid level control 10.

Because of the demands of the cryogenic environment, the materials of the liquid level control must be carefully selected. In the preferred embodiment, the housing 42, the guide 52, and the valve seat 56 were made of fluorocarbon polymers, such as tetra-fluoroethylene polymers, because they do not get brittle at cryogenic temperatures. The float 66 was made of a polystyrene foam, because such foams also have good physical characteristics at cryogenic temperatures and because the closed cell varieties of this foam do not absorb the cryogenic fluid 12. The valve member 54, the fasteners 74 and the actuating levers 72 were made of a good quality steel. Steel, although it turns brittle at cryogenic temperatures, will not break if the stresses it experiences are kept low, as they were in the preferred embodiment.

Referring to FIGS. 1 and 3, the operation of the preferred embodiment will be explained. When the liquid level is at the level shown in FIG. 1 or lower, the float 66 is pulled by gravity to the position shown in FIG. 1. Each hole 76 acts as a pivot for its respective actuating lever 72. The levers 72 thus balance the weight of the float 66 at the outer ends of the actuating levers at one side of the pivot holes 76 against the weight of the valve member 54 and any pressure head from the column of cryogenic fluid 12 in inner conduit 36 at the inner ends on the other side of the pivot holes 76. In FIG. 1, the outlet 62 is fully open, and any excess weight of the float 66 which is not balanced by the valve member 54 is counterbalanced by the valve seat 56. As the cryogenic fluid flows out the outlet 62, the enclosure 14 fills up. As the enclosure 14 fills up, the float 66 will be buoyantly raised to higher levels. Further, as the float 66 is raised to higher levels, the actuating levers 72 pivot such that their ends 78 do not bear so heavily against the valve member 54, allowing the valve member 54 to be pulled by gravity and pushed by fluid pressure closer to the valve seat 56 and thereby reducing the flow of cryogenic fluid out of the outlet 62. Eventually, depending on the pressure of the cryogenic fluid, the float 66 may be raised to the position shown in FIG. 3, where the actuating levers are completely pivoted away from the valve member 54 thereby closing off all flow out of the outlet 62. Additional cryogenic fluid 12 will not enter the enclosure 14 until some of the fluid 12 is evaporated and the level of the float 66 is lowered to a point where the actuating levers 72 again displace the valve member 54. Thus the liquid level control 10 controls the level 11 of the cryogenic fluid 14.

Thus, it will now be understood that there has been disclosed a liquid level control for a cryogenic fluid which operates simply and reliably. While the invention has been particularly illustrated and described with reference to a preferred embodiment thereof, it will be understood by those skilled in the art that various changes in form, details, and applications may be made therein. It is accordingly intended that the appended claims shall cover all such changes in form, details and applications which do not depart from the true spirit and scope of the invention.

What is claimed as new and desired to be secured by Letters Patent of the United States is:

1. An apparatus for maintaining a level of a cryogenic fluid within a cooling enclosure, comprising:

a float for positionally indicating the level of a cryogenic fluid;

said float has a disk shape with an axially symmetric aperture therein;

actuator means connected to said float for providing a mechanical force in response to said float; and a valve responsive to the actuator means for controlling a flow of cryogenic fluid into the cooling enclosure.

2. The apparatus according to claim 1, further comprising vent means for venting a portion of the cryogenic fluid that has absorbed sufficient heat within the cooling enclosure to change into a gaseous state.

3. An apparatus for controlling a cryogenic fluid level, comprising:

a valve housing having a lower portion which serves as a datum for the cryogenic fluid level;

float means for mechanically indicating the cryogenic fluid level relative to the datum;

said float means has a disk shape with an axially symmetric aperture therein;

actuator means connected to the float means for providing a mechanical force and displacement that are functions of a difference between the cryogenic fluid level and the datum; and valve means located within the valve housing responsive to said actuator means for controlling a flow of a cryogenic fluid from an input to an output thereof to reduce the difference between the cryogenic fluid level and the datum.

4. The apparatus according to claim 3, further comprising vent means for venting a portion of the cryogenic fluid that has changed to a gaseous state.

5. The apparatus according to claim 4, wherein the valve housing means and the vent means are made of a fluorocarbon polymer, and the float means is made from a polystyrene foam.

6. The apparatus according to claim 3, wherein the lower portion of the valve housing is slidably located within the axially symmetric aperture of the float means.

7. The apparatus according to claim 6, wherein the valve housing means and is made of a fluorocarbon polymer, and the float means is made from a polystyrene foam.

8. The apparatus according to claim 3, wherein the valve housing means and is made of a fluorocarbon polymer, and the float means is made from a polystyrene foam.

9. An apparatus for controlling a cryogenic fluid level within an enclosure, comprising:

a valve housing having a lower portion with a hollow therein and at least one radial hole through said lower portion in communication with said hollow;

a float having a disk shape with an axially concentric hole therein surrounding said valve housing for mechanically responding to a cryogenic fluid level within said enclosure until said enclosure is filled;

an actuator lever connected to said float at a first end and penetrating through said radial hole into said hollow to provide a mechanical force and displacement in response to said float; and valve means located within the valve housing responsive to said actuator lever at a second end thereof for controlling a flow of a cryogenic fluid from an input to an output thereof until said enclosure is filled.

10. The apparatus according to claim 9, wherein the diameter of said float is substantially the same as the inside diameter of said enclosure except for a clearance distance to allow freedom of motion as the cryogenic fluid boils.

11. The apparatus according to claim 10, wherein a portion of said valve housing surrounding said radial hole acts as a fulcrum for said actuating lever.

12. The apparatus according to claim 9, wherein a portion of said valve housing surrounding said radial hole acts as a fulcrum for said actuating lever.

* * * * *